US006432906B1

(12) United States Patent
Carlson et al.

(10) Patent No.: US 6,432,906 B1
(45) Date of Patent: Aug. 13, 2002

(54) SOLID ACID CLEANING BLOCK AND METHOD OF MANUFACTURING

(75) Inventors: Paula J. Carlson, Brooklyn Park; Cathleen M. Norland, Minneapolis; Nicol M. Larson, St. Paul; John J. Rolando, Woodbury, all of MN (US)

(73) Assignee: Ecolab Inc., St. Paul, MN (US)

( * ) Notice: Subject to any disclaimer, the term of this patent is extended or adjusted under 35 U.S.C. 154(b) by 1184 days.

(21) Appl. No.: 08/748,053

(22) Filed: Nov. 12, 1996

Related U.S. Application Data

(63) Continuation of application No. 08/382,288, filed on Feb. 1, 1995, now abandoned.

(51) Int. Cl.[7] ..... C11D 7/26; C11D 7/60; C11D 17/00

(52) U.S. Cl. ..... 510/446; 510/447; 510/450; 510/477; 510/488; 510/501

(58) Field of Search ..... 510/446, 447, 510/450, 477, 488, 501

(56) References Cited

U.S. PATENT DOCUMENTS

| | | | | |
|---|---|---|---|---|
| 3,816,351 A | | 6/1974 | Lancz | 252/527 |
| 4,175,943 A | | 11/1979 | Jordaan et al. | 71/29 |
| 4,260,592 A | | 4/1981 | Corver et al. | 423/305 |
| T102,902 I4 | | 4/1983 | Khasawneh | 71/29 |
| 4,587,030 A | | 5/1986 | Casey | 252/92 |
| 4,595,520 A | | 6/1986 | Heile et al. | 252/160 |
| 4,624,713 A | | 11/1986 | Morganson et al. | 134/25.2 |
| 4,680,134 A | | 7/1987 | Heile et al. | 252/160 |
| 4,749,508 A | | 6/1988 | Cockrell, Jr. et al. | 252/136 |
| 4,769,159 A | | 9/1988 | Copeland | 252/8.8 |
| RE32,818 E | | 1/1989 | Fernholz et al. | 252/90 |
| 4,877,459 A | | 10/1989 | Cockrell, Jr. et al. | 134/40 |
| 4,975,217 A | * | 12/1990 | Brown-Skrobot et al. | 252/107 |
| 5,198,198 A | | 3/1993 | Gladfelter et al. | 422/264 |
| 5,310,549 A | | 5/1994 | Bull | 424/78.08 |
| 5,358,653 A | | 10/1994 | Gladfelter et al. | 252/90 |
| 5,419,850 A | * | 5/1995 | Backes et al. | 252/174 |
| 5,425,895 A | * | 6/1995 | Backes et al. | 252/174 |

* cited by examiner

*Primary Examiner*—Gregory Delcotto
(74) *Attorney, Agent, or Firm*—Merchant & Gould P.C.

(57) ABSTRACT

A stable, substantially homogeneous, solid block cleaning composition can be made for general purpose cleaning and for cleaning hard surfaces such as floors of varying surface composition. Unique solid block materials contain substantially useful concentrations of liquid acid materials, but are in the form of a stable solid. The acidic solid detergent can be dispensed using a water spray creating a concentrate which can then be diluted in proper ratio to form the use-solution. Such use-solutions may be applied to remove a variety of soils subject to acid cleaning including soils containing water hardness components, inorganic soils, and the like. The acid cleaners can be used alone or in combination with other cleaners in a cleaning protocol for a variety of hospitality, industrial or institutional cleaning locations having a broad spectrum of contaminated soil residue.

26 Claims, No Drawings

SOLID ACID CLEANING BLOCK AND METHOD OF MANUFACTURING

This is a Continuation of application Ser. No. 08/382,288, filed Feb. 1, 1995 now abandoned.

FIELD OF THE INVENTION

The invention relates to improved cleaning compositions for hard surfaces and methods of their manufacture. Further, the invention also relates to solid block cleaning compositions containing acidic components. Still further, the invention relates to acidic solid block cleaning compositions that can contain a variety of optional ingredients which may be used to enhance or broaden the soil removing activity of the acid components. The invention also relates to methods of cleaning hard surfaces comprising dispensing a concentrate by contacting the acid block detergent with an aqueous spray, diluting the concentrate with an appropriate amount of an aqueous diluent to produce an acid cleaning product and applying the product to a soiled surface to remove the soil.

BACKGROUND OF THE INVENTION

Hard surface cleaners useful in institutional and non-institutional environments may take any number of forms. Typically these cleaners are liquid formulations as either a non-aqueous, organic cleaner formulation, or aqueous cleaner formulations that can be neutral, acidic or alkaline in pH when diluted to use solutions. Organic cleaner formulations are commonly prepared in an organic base material such as a solvent or surfactant base. Further these formulations may comprise a variety of ingredients such as sequestrants, rust inhibitors, etc.

Aqueous, neutral, acid, or alkaline cleaners, in use solution concentrations, are typically formulated, using a major proportion of an aqueous diluent and minor, but effective amounts, of surfactants, cosolvents and sequestrants. In large part, these cleaners can be used in the form of an aqueous liquid concentrate that is diluted with water to form the use solution. These dilute liquid cleaning formulations have been useful in a number of cleaning environments. However, dilute liquid cleaning formulations that contain a substantial proportion of an aqueous or organic diluent often entails large transportation costs to move solvent or water. Further, cleaning concentrates in liquid form can often be contaminated or can in some cases deteriorate, phase separate and become useless. Further, liquid materials can spill, splash or otherwise be misused resulting in a safety hazard in contact between users and the alkaline or acid concentrate materials.

A number of aqueous acidic cleaners have been disclosed in the prior art. While there are a large number of patents teaching acid cleaners, the following are representative. Casey, U.S. Pat. No. 4,587,030 teaches a foamable acidic liquid cleaning composition adapted for cleaning soap scum and other hardness components from hard surfaces. The cleaners contain a mixture of oleic organic acid and oleic inorganic acid, a surfactant system and a cosolvent that is particularly adapted to removing soap scum that forms in kitchens, baths, etc. Copeland, U.S. Pat. No. 4,769,159 teaches an institutional fabric softening containing cationic surfactant and organic acid in the form of a stable solid block material comprising acidic fabric softening components. Cockrell, Jr. et al., U.S. Pat. Nos. 4,877,459 and 4,749,508 teach liquid acidic materials for cleaning hard surfaces and in particular quarry tile surfaces. The patents teach specific compositions and generic methods using an acid cleaner for soil removal. Gladfelter, U.S. Pat. No. 5,198,198 teaches generic cleaner compositions manufactured in the form of a pellet material formed inside a water soluble bag. The pellets can have acid components. Inorganic alkaline cast solid materials can be formed using known technologies. Fernholz, U.S. Reissue Patent No. 32,818 teaches a solid block detergent containing large proportions of caustic. Morganson et al, U.S. Patent No. 4,624,713 teaches a solid rinse agent containing a rate dispensing agent for varying the release of the surfactant rinse agent. Heile et al., U.S. Pat. Nos. 4,680,134 and 4,595,520 teaches a lower alkaline detergent which optionally contains various inorganic solids. Solid inorganic fertilizer materials are disclosed in Jordan et al., U.S. Pat. No. 4,175,943; Corver et al., U.S. Pat. No. 4,260,592 and Khasawneh, United States Defensive Publication No. T102902. These patent disclosure documents are primarily directed to particulate inorganic fertilizer compositions containing a blend of materials optimized for fertilizing growing plant tissue. These formulations are not highly acid, nor do they contain components that contribute the cleaning performance of acidic cleaners.

While liquid aqueous acidic cleaners have had success in removing soil from a variety of hard surfaces, the aqueous liquid materials still pose a substantial drawback to a user based on both economic and safety considerations. Accordingly, a substantial need exists in improving acid cleaners to render them more cost effective and safe.

BRIEF DISCUSSION OF THE INVENTION

The invention comprises a solid block acid cleaner comprising a solid matrix including a blend of an acid cleaner component, a surfactant composition selected from the group consisting of an anionic surfactant, a nonionic surfactant or mixtures thereof, and a binding agent or solidification compound resulting in a solid mass of about 100 grams or more. The invention also resides in a preferred solid block acid cleaner composition comprising an acid source which is a solid or substantially a solid at any temperature less than 40° C., and an acid which can exist as a liquid at a temperature less than about 40° C., a surfactant composition having a nonionic selected from the group consisting of an alcohl ethoxlyate, a nonylphenol ethoxylate, an ethoxylated/propoxylated copolymer, and mixtures thereof, and an anionic surfactant selected from the group consisting of alkylsulfate or sulfonate, arylsulfate or sulfonate, alkylaryl sulfate or sulfonate, and mixtures thereof and a solidification compound preferably urea, wherein said solid block acid cleaning composition has a pKa ranging from about 1 to 3. The invention also includes methods of use and manufacture for the composition of the invention.

We have found a unique product format comprising a solid block cleaner composition that when diluted with water (at about 1 wt-% active aqueous solution) produces a product or use solution that exhibits a pH less than about 6. The solid block detergent can contain acids that are normally liquid and acids that are normally solid at room temperature. The solid matrix can be dispensed from the solid state to form an aqueous concentrate having a substantial proportion of acid components plus other additives that can enhance or extend the performance of the acid cleaner material. Such concentrate materials can be further diluted with water to form a use solution. In use, the composition of the invention may be applied to any number of surfaces including floors, counter tops, cleaning and food preparation surfaces, among other materials. Such use solutions can be applied to a variety of hard surfaces in the institutional, hospitality or industrial markets for removal of a variety of soil types.

Further, the invention relates to methods of manufacturing a solid block acid cleaner material. Such materials can contain one or more sources of acidity, solvent or co-solvent, additive detergent or surfactant materials and a solidification agent. The formulated acidic material solidifies through the interaction of the intentionally blended components and can be solidified within a disposable container, a film, a water soluble wrapping material or can be packaged in other convenient packaging material. For the purpose of the materials used in making the acid cleaner of the invention and the acid cleaner of the invention, a "solid" is a composition that, at use temperature, is sufficiently resistant to flow that the unsupported composition will not substantially change shape upon standing. Such a solid can be in the form of a matrix including a hard block or brick or a deformable but rigid aqueous dispersion or hard gel. For the purposes of this invention, a liquid is a material that flows at a substantial rate, at use temperature, such that the unsupported material (removed from a container) will lose its shape upon standing in less than one minute. A matrix can comprise a solid mass or a solidified blend of materials having various particle sizes and states of solidification and can comprise liquid components in the solid in a form and concentration that do not interfere with maintaining a stable solid. The matrix can be made by casting, compressing, pelletizing, etc.

DETAILED DISCUSSION OF THE INVENTION

The invention comprises a solid acid cleaner, a method for its manufacture, and a method of its use.

The Solid Acid Cleaner

The acid cleaner of the invention generally comprises a binding agent, a surfactant composition, and an acidulant or acid source. As a binder or solidification agent, this acid cleaner generally comprises one or more constituents which function to provide a semi-solid or solid consistency to the composition. Any number of binding agents can be used in accordance with the invention. One preferred binding agent is urea. Urea has been found to bind both the acidulant and surfactant composition to provide an aqueous soluble, dispensable solid matrix. While the binding mechanism is not fully understood, urea appears to act through an inclusive mechanism with both the acidulant and surfactant. Inclusion as used herein generally describes the function of complexing between two or more constituents to form an adduct. Generally, the urea complex has two compounds that form a crystalline material. Urea will form inclusion complexes with hydrocarbons, alcohols, fatty acids, fatty esters, polyoxyalkylene polymers such as polyethylene glycols and other compounds. The inclusion complexes have been described as host-guest relation, where urea is the host, and it wrap itself around the guest molecule.

In the context of interactions between the binding agent and surfactant, the inclusive action takes the form of a micellar interaction between the polar urea and the polar portions of the surfactants. With regard to the action or interaction between the binding agent and the acid source, the interaction may be characterized as an acid-based attraction between urea and the acid source. The urea reacts with the surfactant to form crystalline urea adducts or inclusion compounds, wherein the urea molecules are wrapped in a spiral or helical formation around the molecules of surfactant. Generally, urea will form inclusion compounds with long straight-chain molecules of 6 or more carbon atoms but not with branched or bulky molecules.

The acid cleaner compositions of the invention can comprise up to about 50% by weight urea. The cleaner composition can comprise about 10 to 45 wt % urea. Typically, the compositions will have a minimum of about 10% by weight urea. We have found that the preferred compositions, for reasons of economy, desired hardness and solubility, comprise about 15% to 40% by weight urea. Most preferably, the compositions generally comprise about 20% to 30% by weight urea. Urea may be obtained from a variety of chemical suppliers, including Sohio Chemical Company, Nitrogen Chemicals Division. Typically, urea will be available in prilled form, and any industrial grade urea may be used in the context of this invention. The particle size of the urea material before blending in the compositions of the invention, is generally between about 200 and 4000$\mu$.

The composition of the invention also generally comprises a surfactant. This surfactant may include any surfactant constituent or constituents, including compounds, polymers and reaction products. Surfactants function to alter surface tension in the resulting compositions, assist in soil removal and suspension by emulsifying soil and allowing removal through a subsequent flushing or rinse. Any number of surfactants may be used including organic surfactants such as anionic surfactants, cationic surfactants, nonionic surfactants, amphoterics and mixtures thereof.

Anionic surfactants are useful in removing oily soils. Generally, anionic surfactants have a more hydrophobic nature which allows their use in cleaning operations including hard surface washing and laundry operations, intent on cleaning objects with oil sediments. Anionic surfactants useful in the invention include sulfates, sulfonates, and carboxylates such as alkyl carboxylates salts, among others. Exemplary anionic surfactants, include alkyl sulfates and sulfonates, alkyl ether sulfates and sulfonates, alkyl aryl sulfates and sulfonates, aryl sulfates and sulfonates, and sulfated fatty acid esters, among others. Preferred anionic surfactants include linear alkyl sulfates and sulfonates, and alkyl benzyl sulfates and sulfonates. More preferably the alkyl group in each instance has a carbon chain length ranging from about $C_{8-18}$, and the preferred aryl group is benzyl.

Nonionic surfactants which have generally been found to be useful in the invention are those which comprise ethylene oxide moieties, propylene oxide moieties, as well as mixtures thereof. These nonionics have been found to be pH stable in acidic environments, as well as providing the necessary cleaning and soil suspending efficacy. Nonionic surfactants which are useful in the invention include polyoxyalkylene nonionic surfactants such as $C_{8-22}$ normal fatty alcohol-ethylene oxides or propylene oxide condensates, (that is the condensation products of one mole of fatty alcohol containing 8–22 carbon atoms with from 2 to 20 moles of ethylene oxide or propylene oxide); polyoxypropylene-polyoxyethylene condensates having the formula $HO(C_2H_4O)_x(C_3H_6O)_yH$ wherein $(C_2H_4O)_x$ equals at least 15% of the polymer and $(C_3H_6O)_y$ equals 20–90% of the total weight of the compound; alkylpolyoxypropylene-polyoxyethylene condensates having the formula $RO—(C_3H_6O)_x(C_2H_4O)_yH$ where R is a $C_{1-15}$ alkyl group and x and y each represent an integer of from 2 to 98; polyoxyalkylene glycols; butyleneoxide capped alcohol ethoxylate having the formula $(R(OC_2H_4)_y(OC_4H_9)_xOH$ where R is a $C_{8-18}$ alkyl group and y is from about 3.5 to 10 and x is an integer from about 0.5 to 1.5; benzyl ethers of polyoxyethylene and condensates of alkyl phenols having the formula $R(C_6H_4)$ $(OC_2H_4)_xOCH_2C_6H_5$ wherein R is a $C_{6-20}$ alkyl group and x is an integer of from 5 to 40; and alkyl phenoxy polyoxyethylene ethanols having the formula $R(C_6H_4)$ $(OC_2H_4)_xOH$ wherein R is a $C_{8-20}$ alkyl group and x is an integer from 3 to 20. Two specific types of nonionic surfactants have been found to be preferable as effective soil suspending agents in the solid and cleaning composition of the invention. First, polyoxypropylene-polyoxyethylene block polymers have been found to be useful in the invention. These polymers generally have the formula:

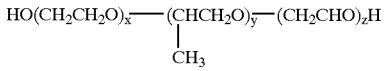

in which on the average x=0–150, preferably, 2–128, y=0–150, and preferably 16–70, and z=0–150, and preferably, 2–128. More preferably, the polyoxypropylene-polyoxyethylene block copolymers used in the invention have a x=2–40, a y=30–70 and a z=2–40. Block nonionic copolymers of this formula are desirable for various applications due to the reduced foaming characteristics these provide. A second and preferred class of nonionic surfactants which is useful in the invention and desirable for other applications are alcohol ethoxylates. Such nonionics are formed by reacting an alcoholate salt (RO-Na+) wherein R is an alcohol or alkyl aromatic moiety with an alkylene oxide. Generally, preferred alkoxylates are C1–12 alkyl phenol alkyloxylates such as the nonyl phenol ethoxylate which generally have the formula:

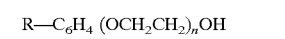

where n may range in value from 6 to 100. Alkyl moieties including a nonyl phenol ethoxylate having an ethoxylate molar value ranging from about 6 moles to 15 moles have been found preferable for reasons of low foaming character and stability in the acidic environment provided by the composition of the invention.

One particularly useful surfactant for use in acid systems include the amine oxide surfactants. Useful amine oxide surfactants have the formula:

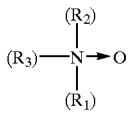

wherein $R_1$ is a $C_8$–$C_{20}$-alkyl or $C_8$–$C_{20}$-alkylamido-$C_2$–$C_5$-alkyl group and $R_2$ and $R_3$ are individually $C_1$–$C_4$-lower alkyl or hydroxy-$C_1$–$C_4$-lower alkyl. Preferably $R_2$ and $R_3$ are both methyl, ethyl or 2-hydroxyethyl. Preferred members of this class include lauryl(dimethyl)amine oxide (Ninox® L, Stephan Chemical Co., Northfield, Ill.), cocodimethyl amine oxide (Ninox® C), myristyl(dimethyl) amine oxide (Ninox® M), stearyl(dimethyl)amine oxide (Schercamox® DMS, Scher Chemicals, Inc., Clifton, N.J.), coco(bixhydroxyethyl)amine oxide (Schercamox® CMS), tallow(bis-hydroxyethyl)amine oxide and cocoamidopropyl (dimethyl)amine oxide (Ninox Calif.). Although in alkaline solutions these surfactants are nonionic, in acidic solutions they adopt cationic characteristics. Preferably, the amine oxide surfactants will comprise about 1–15% of the present compositions, most preferably about 2–10%

Cationic surfactants may also be used in the acid cleaner of the invention quaternary ammonium compounds. Also useful as antimicrobials in the invention are cationic surfactants including quaternary ammonium chloride surfactants such as N-alkyl($C_{12-18}$) dimethylbenzyl ammonium chloride, N-tetradecyldimethylbenzyl ammonium chloride monohydrate, N-alkyl($C_{12-14}$) dimethyl 1-napthylmethyl ammonium chloride available commercially from manufacturers such as Stepan Chemical Company.

The surfactant or surfactant system will comprise up to about 70% by weight of the total acid cleaning composition. Typically, the weight-percent surfactant will be in the range of about 10%–15% by weight, or more preferably, for improved cleaning efficacy, in the range of about 20%–40% by weight. In a preferred mode wherein the acid cleaner composition comprises about and 10 to 70 wt % of surfactant blend, the surfactant composition can comprise about 0.1 to 60 wt % of an alkyl sulfonate, about 10 to 70 wt % of a nonionic comprising a $C_{6-18}$ alcohol ethoxylate or a $C_{6-12}$ alkyl phenol ethoxylate.

The surfactant composition can comprise a mixture nonionic and anionic surfactants. Preferably, the nonionic surfactant will comprise a $C_{6-12}$ alkyl phenol ethoxylate comprising from about to 5–15 moles of EO and the anionic surfactant is preferably a linear alkyl sulfate or sulfonate with an alkyl chain of about $C_{8-18}$. Overall, the surfactant composition comprises from about 10–70% by weight and the anionic surfactant comprising about 0–60%, most preferably 1–55% by weight of the entire composition in this preferred mode.

The acid cleaning composition of the invention also contains an acidulant or acid source. The acid source can comprise a single source. The source can be a liquid or a solid acid or a mixture thereof. The liqiud acid can be a normally liquid material or an aqueous acid composition. The acidulant functions to produce a pH in the diluted use composition of less than 6.5 and, in turn, increase the cleaning efficacy of the composition. In the context of this invention, cleaning efficacy generally means the ability to clean hard surfaces including the removal of organic waste such as greases, oils, and fatty soils. The acidulant may also function to facilitate removal of salt and scale buildup on application surfaces such as floor and waste areas exposed to the composition. The acid block composition can contain a solid acid in an amount of about 0.1 to 80 wt % of the Ad If cleaner composition. The solid acid block can also comprise about 10 to 80 wt % of a liquid acid composition. Preferably the solid acid block can contain about 10 to 80 wt % of the solid acid cleaner and about 10 to 70 wt % of the liquid acid.

Generally, any normally liquid or normally solid acid source which will facilitate the formation of a solid product, may be used in the composition of the invention. Both organic and inorganic acids have been found to be generally useful in the present composition. Organic acids useful in accordance with the invention include hydroxyacetic (glycolic) acid, citric acid, formic acid, acetic acid, propionic acid, butyric acid, valeric acid, caproic acid, gluconic acid, and itaconic acid, trichloroacetic acid, benzoic acid, among others. Organic dicarboxolic acids such as oxalic acid, malonic acid, succinic acid, glutaric acid, maleic acid, fumaric acid, adipic acid, terephthalic acid among others are also useful in accordance with the invention. Any combination of these organic acids may also be used intermixed or with other organic acids which allow adequate formation of the composition of the invention. Inorganic acids useful in accordance with the invention include phosphoric acid, sulfuric acid, sulfamic acid, methylsulfamic acid, hydrochloric acid, hydrobromic acid, and nitric acid among others. These acids may also be used in combination with other inorganic acids or with those organic acids mentioned above.

In accordance with a preferred aspect of the invention, the acidulant source used in the invention will comprise a combination of liquid or solution based acid source and solid acid source. The concentration of the acid as a percentage of the entire composition will generally vary from about 10 to 80% by weight preferably from about 20 to 60% by weight, and most preferably from about 30 to 50% by weight. Of this composition, about 0 to 80% by weight preferably about 1 to 60% by weight, and most preferably about 1 to 40% by weight comprise solid acid with the balance being a liquid or solution-based source of acid.

Further, we have found that a combination of 10 wt % to 35 wt % of a solid acid preferably citric acid combined with 10 wt % to 25 wt % of a liquid acid source, preferably hydroxy acetic (glycolic) acid (40–75% w/v aqueous) as a total percentage of the acid concentration and the composition provides the most preferred solid acid cleaning composition. The useful ranges of materials are displayed in the following table. Only the acid, some proportion of surfactant, water and urea are required. The amount of water used to obtain the best quality and dispensible solid falls in the range of weight ratios of about 1 to 6 parts of urea per each part of water.

Solid Acid Cleaner Compositions

| | Preferred | More Preferred | Most Preferred |
|---|---|---|---|
| Urea | 10–45 | 15–35 | 20–30 |
| Surfacant Composition[1] | 10–45 | 15–35 | 20–30 |
| Anionic | 1–30 | 1–15 | 1–10 |
| Nonionic | 5–15 | 2–20 | 1–25 |
| Acidulant | 5–75 | 11–70 | 20–65 |
| Aqueous Liquid[2] | 0–15 | 1–15 | 5–10 |
| Defoamer | 0–5 | — | 0.1–3 |

[1]Total surfactant.
[2]Total water, same water may be derived from the other ingredients. Total water content in about 1 part water per each 1–6 parts urea.

The Method of Manufacturing

The acid cleaner of this invention may be manufactured or formulated through any number of processes. Processes such as conventional batch processing (in line mill optionally and for particular size adjustment), extrusion processing, semi-continuous processing, are all useful methods of formulating the composition invention. One preferred method of formulating the composition of the invention is a semi-continuous method using an in-line mill to obtain a preferred partial size range for blending and solidification, less than 1000$\mu$, and most prefferably about 100 to 2000$\mu$. In this method, all raw materials except for the urea are combined in a large stock tank. A stub batch is prepared by pumping a portion (5–20 wt %) of the original material from the stock tank into a premix tank. The entire urea amount is added to the premix tank and the urea is incorporated into the liquid. After reaching uniformity, the mixture is diverted to an in-line mill. After milling the mixture is combined with the balance of the composition and is placed in a plastic capsule (sized to include about 1–10 lbs. (about 0.5 to 5 kg) of mixture for solidification. Alternatively, with or without milling, the urea and the mixture can be heated and mixed until uniform and can be placed into a plastic capsule for cooling and solidification.

When milling to control partial size, once the mill is started, the liquid raw material and urea are fed continuously into the pre-mix tank. The rate of continuous feeding to the pre-mix tank and fill rate from the pre-mix tank should be set so that the liquid level in the tank is maintained at a constant volume. This level should be set at the minimum volume in which the urea can be suspended. The temperature of the pre-mix tank should be about 165° F., preferably between 150–170° F. The stock temperature should be maintained at 120–175° F.

The maintenance of this temperature will preclude the liquid from solidifying in the pre-mix tank. Agitation both in the stock tank and in the pre-mix tank should be kept at a minimum. Preferably, the pipelines between the tanks and the filler will be warmed prior to use. All filled containers are passed through an air cooler immediately after filling for a minimum of 15 minutes.

In greater detail, the invention may be formulated in an alternative manner by, charging the liquid acid into a mixing tank and initiate heating to 200° F. During this heating period, the tank is initially charged with the intended volume of solid and liquid acid. The acids are mixed at 200° F. until all of the acid source is dissolved within the liquid acid source. Once the acid sources are dissolved, the tank may then be charged with the surfactant. Once mixed for an effective period of time, usually about 15 minutes, the tank is then heated as necessary to attain a temperature of 180° F.

At this time, urea, preferably in prilled form is charged into the tank. The tank is preferably maintained at a temperature of 175° F. throughout the addition. Once the mixture obtains a homogeneous consistency, the composition may then be decanted into filling vessels. Preferably the cooling time of the mixed acid composition is about 30 to 60 min. and most preferably about 40 to 50 min. so as to reduce the level of expansion in the urea product.

Once formulated, the composition of the invention may be dissolved to provide a use-dilution for any number of applications including institutional applications, hospitality applications, kitchen applications, etc. The use-dilution table may be found below at table 2.

TABLE 2

| AQUEOUS USE DILUTION CONCENTRATIONS | |
|---|---|
| Preferred | 100–100,000 ppm[3] |
| More Preferred | 150–46,000 ppm |
| Most Preferred | 200–4,600 ppm |

[3]Total solids from the solid cleaner.

Working Examples

The working examples provided below are intended to be illustrative of the invention which should not be construed to limit the invention.

Examples 1–42

Working Examples 1–42 were formulated to provide the acid block composition of the invention.

Working Examples

| RAW MATERIAL | 1 | 3 | 4 | 5 | 6 | 7 | 8 | 9 | 10 | 11 | 12 | 13 | 14 | 15 |
|---|---|---|---|---|---|---|---|---|---|---|---|---|---|---|
| Phosphoric Acid (75% aqueous) | 0 | 40 | 40 | 0 | 0 | 40 | 40 | 40 | 40 | 36 | 36 | 36 | 36 | 30 |
| Citric Acid | 0 | 20 | 20 | 10 | 10 | 10 | 10 | 10 | 10 | 10 | 10 | 10 | 5 | 0 |
| Hydroxyacetic Acid (70% aqueous) | 22.5 | 0 | 0 | 40 | 40 | 0 | 0 | 0 | 10 | 10 | 10 | 0 | 0 | 0 |
| SOKALAN DCS about 25 wt % adipic, about 50 wt % glutaric, about 25 wt % succinic | 0 | 0 | 0 | 0 | 0 | 0 | 0 | 0 | 0 | 0 | 0 | 0 | 0 | 0 |
| Sulfamic Acid (granular) | 0 | 0 | 0 | 0 | 0 | 0 | 0 | 0 | 0 | 0 | 0 | 10 | 15 | 24 |
| Urea | 26 | 23 | 23 | 23 | 23 | 23 | 23 | 24 | 25 | 25 | 25 | 23 | 23 | 23 |
| nonyl phenol 6.5 mole ethoxylate | 7 | 0 | 0 | 0 | 5 | 5 | 10 | 15 | 5 | 5 | 0 | 0 | 0 | 0 |
| nonyl phenol 9.5 mole ethoxylate | 0 | 0 | 0 | 0 | 0 | 0 | 0 | 0 | 0 | 0 | 12 | 12 | 12 | 12 |
| LAS linear alkans sulfonate (Flake) | 0 | 0 | 0 | 0 | 0 | 0 | 5 | 3 | 5 | 9 | 0 | 0 | 0 | 0 |
| Sulfonic Acid | 7 | 10 | 10 | 10 | 10 | 10 | 10 | 8 | 5 | 5 | 5 | 7 | 7 | 7 |
| Antifoam 544 (silicone antifoam) | 0 | 0 | 0 | 0 | 0 | 0 | 0 | 0 | 0 | 0 | 0 | 0 | 0 | 0 |
| Fragrance (optional) | 1 | 2 | 2 | 2 | 2 | 2 | 2 | 0 | 0 | 0 | 2 | 2 | 2 | 2 |
| Dye | 0 | 0 | 0 | 0 | 0 | 0 | 0 | 0 | 0 | 0 | 0 | 0 | 0 | 0 |
| Igepal DM 970 nonyl phenol 150 mole ethoxylate | 14.5 | 5 | 0 | 15 | 10 | 10 | 0 | 0 | 0 | 0 | 0 | 0 | 0 | 0 |
| Chemal LA-23 $C_{12}$ alcohol 23 mole ethoxylate | 0 | 0 | 5 | 0 | 0 | 0 | 0 | 0 | 0 | 0 | 0 | 0 | 0 | 0 |
| PEG 8000 (polyethylene glycol) | 9 | 0 | 0 | 0 | 0 | 0 | 0 | 0 | 0 | 0 | 0 | 0 | 0 | 0 |
| Glacial Acetic Acid | 13 | 0 | 0 | 0 | 0 | 0 | 0 | 0 | 0 | 0 | 0 | 0 | 0 | 0 |
| EDTA | 0 | 0 | 0 | 0 | 0 | 0 | 0 | 0 | 0 | 0 | 0 | 0 | 0 | 0 |
| Pluronic F-85 ($EO_{27}PO_{39}EO_{27}$) | 0 | 0 | 0 | 0 | 0 | 0 | 0 | 0 | 0 | 0 | 0 | 0 | 0 | 0 |
| SOLID | NO | YES | YES | NO | SOFT SOLID | YES | YES | YES | YES | SOFT | YES | YES | | YES |
| TOTAL | 100 | 100 | 100 | 100 | 100 | 100 | 100 | 100 | 100 | 100 | 100 | 100 | 100 | 98 |

| RAW MATERIAL | 16 | 17 | 18 | 19 | 20 | 21 | 22 | 23 | 34 | 34a | 34b | 34c |
|---|---|---|---|---|---|---|---|---|---|---|---|---|
| Phosphoric Acid (75% aqueous) | 33 | 35 | 36 | 43 | 40 | 40 | 43 | 43 | 20 | 10 | 20 | 10 |
| Citric Acid | 0 | 0 | 5 | 0 | 0 | 10 | 13 | 13 | 10 | 10 | 10 | 20 |
| Hydroxyacetic Acid (70% aqueous) | 0 | 10 | 0 | 0 | 0 | 0 | 0 | 0 | 20 | 20 | 10 | 10 |
| SOKALAN DCS about 25 wt % adipic, about 50 wt % glutaric, about 25 wt % succinic | 0 | 0 | 0 | 0 | 0 | 0 | 0 | 0 | 0 | 10 | 10 | 10 |
| Sulfamic Acid (granular) | 24 | 10 | 5 | 0 | 0 | 0 | 0 | 0 | 0 | 0 | 0 | 0 |
| Urea | 23 | 25 | 23 | 25 | 25 | 20 | 26 | 26 | 23 | 23 | 23 | 23 |
| nonyl phenol 6.5 mole ethoxylate | 0 | 0 | 0 | 0 | 0 | 0 | 0 | 4 | 0 | 0 | 0 | 0 |
| nonyl phenol 9.5 mole ethoxylate | 12 | 10 | 12 | 12 | 10 | 10 | 6 | 6 | 5 | 5 | 5 | 5 |
| LAS linear alkans sulfonate (Flake) | 0 | 0 | 0 | 0 | 0 | 0 | 0 | 0 | 0 | 0 | 0 | 0 |
| Sulfonic Acid | 3 | 8 | 5 | 5 | 5 | 8 | 10 | 0 | 10 | 10 | 10 | 10 |
| Antifoam 544 (silicone antifoam) | 0 | 0 | 0 | 0 | 0 | 0 | 0 | 0 | 0 | 0 | 0 | 0 |
| Fragrance (optional) | 2 | 2 | 2 | 2 | 2 | 2 | 2 | 2 | 2 | 2 | 2 | 2 |
| Dye | 0 | 0 | 0 | 0 | 0 | 0 | 0 | 0 | 0 | 0 | 0 | 0 |
| Igepal DM 970 nonyl phenol 150 mole ethoxylate | 0 | 0 | 0 | 0 | 0 | 0 | 0 | 0 | 10 | 10 | 10 | 10 |
| Chemal LA-23 $C_{12}$ alcohol 23 mole ethoxylate | 0 | 0 | 0 | 0 | 0 | 0 | 0 | 0 | 0 | 0 | 0 | 0 |
| PEG 8000 (polyethylene glycol) | 0 | 0 | 12 | 15 | 18 | 10 | 0 | 0 | 0 | 0 | 0 | 0 |
| Glacial Acetic Acid | 0 | 0 | 0 | 0 | 0 | 0 | 0 | 0 | 0 | 0 | 0 | 0 |
| EDTA | 0 | 0 | 0 | 0 | 0 | 0 | 0 | 6 | 0 | 0 | 0 | 0 |
| Pluronic F-85 ($EO_{27}PO_{39}EO_{27}$) | 0 | 0 | 0 | 0 | 0 | 0 | 0 | 0 | 0 | 0 | 0 | 0 |
| SOLID | SOFT SOLID | SOFT SOLID | PASTE | PASTE | PASTE | NO | YES | YES | PASTE | PASTE | PASTE | PASTE |
| TOTAL | 97 | 100 | 100 | 102 | 100 | 100 | 100 | 100 | 100 | 100 | 100 | 100 |

| RAW MATERIAL | 36 | 37 | 38 | 39 | 4C | 41 | 42 |
|---|---|---|---|---|---|---|---|
| Phosphoric Acid (75% aqueous) | 30 | 35 | 35 | 30 | 30 | 30 | 25 |
| Citric Acid | 10 | 5 | 20 | 15 | 20 | 20 | 15 |
| Hydroxyacetic Acid (70% aqueous) | 10 | 10 | 0 | 10 | 0 | 0 | 10 |
| SOKALAN DCS about 25 wt % adipic, about 50 wt % glutaric, about 25 wt % succinic | 0 | 0 | 0 | 0 | 0 | 0 | 0 |
| Sulfamic Acid (granular) | 0 | 0 | 0 | 0 | 0 | 0 | 0 |
| Urea | 25 | 25 | 23 | 23 | 23 | 23 | 23 |
| nonyl phenol 6.5 mole ethoxylate | 0 | 0 | 0 | 0 | 5 | 7.5 | 7.5 |
| nonyl phenol 9.5 mole ethoxylate | 10 | 10 | 5 | 5 | 5 | 7.5 | 7.5 |
| LAS linear alkans sulfonate (Flake) | 0 | 0 | 0 | 0 | 0 | 0 | 0 |
| Sulfonic Acid | 5 | 5 | 10 | 10 | 10 | 10 | 10 |
| Antifoam 544 (silicone antifoam) | 0 | 0 | 0 | 0 | 0 | 0 | 0 |

-continued

| Working Examples | | | | | | | |
|---|---|---|---|---|---|---|---|
| Fragrance (optional) | 2 | 2 | 2 | 2 | 2 | 2 | 2 |
| Dye | 0 | 0 | 0 | 0 | 0 | 0 | 0 |
| Igepal DM 970 nonyl phenol 150 mole ethoxylate | 8 | 8 | 5 | 5 | 5 | 0 | 0 |
| Chemal LA-23 $C_{12}$ alcohol 23 mole ethoxylate | 0 | 0 | 0 | 0 | 0 | 0 | 0 |
| PEG 8000 (polyethylene glycol) | 0 | 0 | 0 | 0 | 0 | 0 | 0 |
| Glacial Acetic Acid | 0 | 0 | 0 | 0 | 0 | 0 | 0 |
| EDTA | 0 | 0 | 0 | 0 | 0 | 0 | 0 |
| Pluronic F-85 ($EO_{27}PO_{39}EO_{27}$) | 0 | 0 | 0 | 0 | 0 | 0 | 0 |
| SOLID | PASTE | PASTE | YES | YES | YES | YES | YES |
| TOTAL | 100 | 100 | 100 | 100 | 100 | 100 | 100 |

OBJECTIVE:

Two samples of an acid floor cleaner were submitted for the determination of any sanitizing capabilities.

TEST PROCEDURE:

Test Method: Germicidal and Detergent Sanitizing Action of Disinfectants—Final Action (Test Procedure No. AOAC 960.09 Germicidal and detergent sanitizing action of disinfectants)

Test Substance: *Staphylococcus aureus* ATCC 6538 *Escherichia coli* ATCC 11229

Exposure Times: 30 seconds, 1 minute, and 5 minutes

Test Temperature: 25° C.

Neutralizer: Chamber's Neutralizer

Subculture Media: Tryptone Glucose Extract Agar

Incubation: 37° C. for 48 hours

Results:

*STAPHYLOCOCCUS AUREUS* INOCULUM=37×$10^6$ cfu/ml

| Sample | Exposure | Survivors /ml | % Reduction | Post Test pH |
|---|---|---|---|---|
| A @ 0.5% | 30 seconds | $<1 \times 10^1$ | >99.999 | 2.52 |
| | 1 minute | $<1 \times 10^1$ | >99.999 | |
| | 5 minutes | $<1 \times 10^1$ | >99.999 | |
| B @ 0.5% | 30 seconds | $207 \times 10^5$ | 44.054 | 2.50 |
| | 1 minute | $103 \times 10^5$ | 72.162 | |
| | 5 minutes | $172 \times 10^3$ | 99.535 | |

*ESCHERICHIA COLI* INOCULUM=90×$10^6$ cfu/ml

| Sample | Exposure | Survivors /ml | % Reduction | Post Test pH |
|---|---|---|---|---|
| A @ 0.5% | 30 seconds | $36 \times 10^1$ | >99.999 | 2.41 |
| | 1 minute | $<1 \times 10^1$ | >99.999 | |
| | 5 minutes | $<1 \times 10^1$ | >99.999 | |
| B @ 0.5% | 30 seconds | $415 \times 10^5$ | 53.889 | 2.45 |
| | 1 minute | $443 \times 10^5$ | 50.778 | |
| | 5 minutes | $360 \times 10^5$ | 60.000 | |

-continued

| Raw Materiais | A | B |
|---|---|---|
| $C_{12}$ Alcohol (23 mole) Ethoxylate | 10.00 | 21.00 |
| Alcohol Ethoxylate | | |
| Pluronic F-85 EO/PO Block Polymer | 5.00 | 3.00 |
| Linear Alkyl Benzene Sulfonic Acid | 9.00 | |
| Urea | 23.50 | 23.50 |
| Citric Acid | 30.00 | 30.00 |
| Glycolic Acid (70%) Active Aqueous | 22.50 | 22.50 |
| Totals | 100.00 | 100.00 |

Conclusions: Acid floor cleaner sample P06144A demonstrated sanitizing efficacy against both *Staphylococcus aureus* and *Escherichia coli* after 30 seconds exposure. Acid floor cleaner sample P09204A demonstrated little or no efficacy against either organism after 5 minutes. Activity against *Escherichia coli* was worse than against *Staphylococcus aureus*.

We have found that the compositions of the invention are particularly useful in cleaning soils comprising food residue in combination with inorganic components. In particular, the compositions of the invention are useful in cleaning hard surfaces such as sinks, counters, floors, walls, tables, etc. that can accumulate substantial residues of soil comprising carbohydrate residue, protein residue, fatty soil residue comprising neutral fats, fatty acids and calcium, sodium, potassium, salts or fatty acids in combination with hardness components derived from common utility service water. In particular, such complex soils can form on hard floor surfaces such as grouted quarry tile surfaces. Such surfaces that can be formed on walls, countertops or floors can have soiled quarry tile and substantial quantities of soil on grout lines form around the quarry tile. The compositions of the invention can be used in the method of cleaning such surfaces that can remove substantial proportions of soil rendering the floor substantially clean. The cleanliness of the floor is characteristic of a substantially improved coefficient of friction (COF). A coefficient of friction greater than about 0.5 and preferably greater than about 0.4 connotes a non-slip floor of substantially improved safety when compared to slippery soiled floor surfaces. Further, the floors can be characteristically free of soil residue as measured by FTIR (Fourier Transform Infrared Spectra Technology) which is a surface scanning technology adapted for the analysis of surface residues.

We have also been using more conventional testing methods that substantial quantities of calcium fatty acid salts in combination with fatty acids and other residues derived from food sources can readily be cleaned from floor surfaces using the compositions of the invention. Typically, the compositions of the invention can clean from hard floor surfaces, or other hard surfaces, greater than 60%, typically 70–85% of such soils from these common hard surfaces. The following procedure is a typical procedure for measuring the removal of a synthetic soil from hard surfaces.

Kitchen Floor Soil Gardner Straight Line Soil Removal Test Procedure

PURPOSE: To compare the cleaning efficiencies of various detergent formulations. This test may be used to compare competitive products to Ecolab products.

PRINCIPLE: Quarry floor tiles are baked at 200° F. for 2 hours with a soil mixture that reproduces soil found on a restaurant kitchen floor. Tiles are then read on the UltraScan Spectrophotometer instrument before and after the test procedure.

The Gardner Straight Line Washability apparatus, Model WG 8100 is used to clean the soled tiles using a nylon brush (from Gardner), using use dilution concentrations of detergents.

APPARATUS AND MATERIALS:

1. Gardner Straight Line apparatus with plastic template, 21 15/16"×6 15/16"×½". Two holes 3 1/16"×3 1/16.
2. UltraScan Spectrophotometer instrument. See the attached UltraScan setup sheets.
3. Cream, solid quarry tile, 3"×3" panels. Supplier: Color Tile, St. Paul, Minn.
4. Paint brush, 1" width (not nylon).
5. Gardner Straight Line brush (two brushes joined together 2¾" W×3½" L.
6. Balance.
7. Graduated cylinder (200 mls).
8. Oven (preheated to 200° F.).

TITLE SOILING PROCEDURE:

1. If using the UltraScan to obtain data, an initial reading of the tiles is needed. Read the smooth side of the quarry tiles (4 tiles for each product concentrated tested).
2. Mix the soil, such as a cakcium fatty acid soil, well before applying to the tile, maintaining the consistency of the soil that is needed to spread over the tile. Place tile on the balance and tare. Apply −2.0 grams of soil and using the paint brush spread it over the surface stroking in one direction and then turn the tile and crisscross over the strokes.

Soil only enough tiles that will be needed for the test.
3. Place the files in the oven (preheated to 200° F.) and bake for 2 hours. Remove and let sit overnight (tiles should not be kept or used after 1 day).

SOIL REMOVAL TEST PROCEDURE:

1. Make up test solutions typically at 2 oz/gal (1.5 wt %) use the appropriate water for your testing. Once a water has been selected it should be used throughout the test.
2. Place the plastic template inside the Gardner Straight Line and place the brush into the housing box.
3. Place 2 soiled tiles into the template openings.
4. With the graduated cylinder pour 200 mls of the test solution into the tray.
5. Start the machine immediately, washing the tiles for 32 passes (rotate tile after every 8 passes).
6. Remove the brush and tiles and rinse them with warm water.
7. Air dry tiles.

RECORDING DATA:

Use appropiate Ultrascan machine set-up and record Ultrascan reading before (B) and after (A) cleaning soiled tile.

A=After

B=Before

CALCULATIONS:

$$(A-B)/(\text{Initial:}B)\times 100=CE$$

INTERPRETATION OF RESULTS:

To eliminate variations from one batch of soil to another and the variations in application from one tester to another, do not compare results for similar products unless tests are run on the same day with the same soil and the same person performing the test procedure. This is an empirical test good only for comparison purposes. Add to the test a product that has a known result as a comparison to all other detergents run during each testing run.

The above, discussions, examples and data represent are our current understanding of the invention. However, since many variations of the invention can be made without departing from the spirit and scope of the invention, the invention resides in the claims hereinafter appended.

We claim:

1. An acid cleaner composition comprising:

a) an effective amount of an acid component comprising at least 5 wt. % of a normally liquid acid an at least 5 wt. % of a normally solid acid, the total weight of both acids are at least 10 wt. %; wherein the normally solid acid is a solid at a temperature less than about 40° C. and the normally liquid acid is a liquid at a temperature of less than about 40° C.;

b) an effective soil suspending amount of a surfactant composition;

c) an effective solidifying amount of a urea compound; and d) water in an amount of about 1 part water per each 1 to 6 parts urea; wherein the solid block cleaner composition is solidified and held within a disposable plastic container.

2. The composition of claim 1 wherein said acid composition is selected from the group consisting of an inorganic acid, an organic acid, and mixtures thereof.

3. The composition of claim 2 wherein said inorganic acid is selected from the group consisting of phosphoric acid, sulfuric acid, sulfamic acid, hydrochloric acid, hydrobromic acid, nitric acid, and mixtures thereof.

4. The composition of claim 2 wherein said organic acid is selected from the group consisting of hydroxyacetic acid, citric acid, formic acid, acetic acid, propionic acid, butyric acid, valeric acid, caproic acid, gluconic acid, itaconic acid, oxalic acid, malonic acid, succinic acid, glutaric acid, maleic acid, fumaric acid, adipic acid, methyl sulfamic acid and mixtures thereof.

5. The composition of claim 1 wherein said solid acid comprises 0.1 to 80 wt. % of the cleaner composition said liquid acid comprises 10–80 wt. % of the cleaner composition, and said block comprises about 10–45 wt. % urea.

6. The composition of claim 5 wherein said solid acid has a concentration ranging from about 10 to 80 wt. % of the acid cleaner composition and said liquid acid has a concentration ranging from about 10 to 70 wt. % of the acid cleaner composition.

7. The composition of claim 5 additionally comprising a defoamer.

8. The composition of claim 1 wherein said surfactant composition is selected from the group consisting of a nonionic surfactant, an anionic surfactant, a cationic surfactant, and mixtures thereof.

9. The composition of claim 8 wherein said nonionic surfactant is selected from the group consisting of an alcohol ethoxylate, an ethoxylated-propoxylated copolymer, a nonyl phenol ethoxylate, and mixtures thereof.

10. The composition of claim 8 wherein said anionic surfactant is selected from the group consisting of an alkyl sulfate or sulfonate, an aryl sulfate or sulfonate, an alkyl aryl sulfate or sulfonate, and mixtures thereof.

11. The composition of claim 1 wherein said surfactant composition comprises a mixture of nonionic surfactant and anionic surfactant, said nonionic surfactant comprising an alcohol ethoxylate, a nonylphenol ethoxylate and said anionic surfactant comprising a linear alkyl sulfate or sulfonate.

12. The composition of claim 11 wherein said surfactant composition comprises about 10 to 70 wt. % of said acid cleaner composition.

13. The composition of claim 12 wherein the composition comprises about 1 to 60 wt. % of an alkyl sulfonate and from about 10 to 70 wt. % of a nonionic comprising a $C_{6-18}$ alcohol ethoxylate or a $C_{6-12}$ alkylphenol ethoxylate.

14. The composition of claim 1 wherein upon diluting to 10 wt. % aqueous or less said acid composition has a pKa less than about 6.

15. The composition of claim 1 wherein upon dilution to 10 wt. % or less, the acid composition has a pKa that ranges from about 1 to 3.

16. An acid cleaner composition comprising:

a) an effective amount of an acid component comprising at least 5 wt. % of a normally liquid acid and at least 5 wt. % of a normally solid acid, the total weight of both acids are at least 10 wt. %; wherein the normally solid acid is a solid at a temperature less than about 40° C. and the normally liquid acid is a liquid at a temperature of less than about 40° C.;

b) an effective soil suspending amount of a surfactant composition;

c) an effective solidifying amount of a urea compound; and d) about 5 to 10 wt.-% water; wherein the acid block cleaner composition is solidified and held in a disposable plastic container.

17. An acid cleaner composition consisting essentially of:

a) an effective amount of an acid component comprising at least 5 wt. % of a normally liquid acid and at least 5 wt. % of a normally solid acid, the total weight of both acids are at least 10 wt. %; wherein the normally solid acid is a solid at a temperature less than about 40° C. and the normally liquid acid is a liquid at a temperature of less than about 40° C.;

b) an effective soil suspending amount of a surfactant composition; and c) an effective solidifying amount of a urea compound; wherein the acid block cleaner composition is solidified and held in a disposable plastic container.

18. An acid cleaner composition comprising:

a) an effective amount of an acid component comprising:
   i) about 5 to 40 wt. % of phosphoric acid;
   ii) about 2 to 20 wt. % of citric acid; and
   iii) about 5 to 25 wt. % of sulfamic acid; wherein the total weight of the acids are at least 10 wt. % of the acid cleaner;

b) an effective soil suspending amount of a surfactant composition;

c) an effective solidifying amount of a urea compound; and d) an effective amount of water for solidification; wherein the composition is solidified into a solid block and is held within a disposable plastic container.

19. The composition of claim 18 wherein said acid comprises 10 to 80 wt. % of the cleaner composition and said block comprises about 1–45 wt. % urea.

20. The composition of claim 18 additionally comprising a defoamer.

21. The composition of claim 18 wherein said surfactant composition is selected from the group consisting of a nonionic surfactant, an anionic surfactant, a cationic surfactant, and mixtures thereof.

22. The composition of claim 21 wherein said nonionic surfactant is selected from the group consisting of an alcohol ethoxylate, an ethoxylated-propoxylated copolymer, a nonyl phenol ethoxylate, and mixtures thereof.

23. The composition of claim 21 wherein said anionic surfactant is selected from the group consisting of an alkyl sulfate or sulfonate, an aryl sulfate or sulfonate, an alkyl aryl sulfate or sulfonate, and mixtures thereof.

24. The composition of claim 18 wherein said surfactant composition comprises a mixture of nonionic surfactant and anionic surfactant, said nonionic surfactant comprising an alcohol ethoxylate, a nonylphenol ethoxylate and said anionic surfactant comprising a linear alkyl sulfate or sulfonate.

25. The composition of claim 11 wherein said surfactant composition comprises about 10 to 70 wt. % of said acid cleaner composition.

26. The composition of claim 12 wherein the surfactant composition further comprising about 0.1 to 60 wt. % of an alkyl sulfonate and from about 10 to 70 wt. % of a nonionic surfactant comprising a $C_{6-18}$ alcohol ethoxylate or a $C_{6-12}$ alkylphenol ethoxylate.

* * * * *

UNITED STATES PATENT AND TRADEMARK OFFICE

CERTIFICATE OF CORRECTION

PATENT NO. : 6,432,906 B1
DATED : August 13, 2002
INVENTOR(S) : Carlson et al.

It is certified that error appears in the above-identified patent and that said Letters Patent is hereby corrected as shown below:

Column 6,
Line 9, "comprises about and 10 to 70 wt % of a …" should read -- comprises about 10 to 70 wt % of a … --
Lines 37-38, "0.1 to 80 wt % of the Ad If cleaner composition." should read -- 0.1 to 80 wt % of the cleaner composition. --

Column 14,
Line 22, "… acid an at least 5…" should read -- ...acid and at least 5… --

Signed and Sealed this

Twenty-second Day of April, 2003

JAMES E. ROGAN
*Director of the United States Patent and Trademark Office*